United States Patent [19]

Imperio

[11] 4,137,801

[45] Feb. 6, 1979

[54] COMBINED RATCHET AND TORSION WRENCH

[76] Inventor: Charles D. Imperio, 243 Billy Mitchell, Ellsworth Air Force Base, S. Dak. 57706

[21] Appl. No.: 772,727

[22] Filed: Feb. 28, 1977

[51] Int. Cl.[2] ..... B25B 13/00

[52] U.S. Cl. ..... 81/58.1; 81/62

[58] Field of Search ..... 81/58.1, 62, 57.29

[56] References Cited

U.S. PATENT DOCUMENTS

| | | | |
|---|---|---|---|
| 2,703,030 | 3/1955 | Marvin | 81/58.1 |
| 3,467,231 | 9/1969 | Haznar | 81/62 |
| 3,707,893 | 1/1973 | Hofman | 81/58.1 |
| 3,733,936 | 5/1973 | Flynn | 81/58.1 |
| 3,952,617 | 4/1976 | Gegg | 81/62 |

*Primary Examiner*—James L. Jones, Jr.
*Attorney, Agent, or Firm*—Keith B. Davis

[57] ABSTRACT

A combined ratchet and torsion wrench which in the preferred embodiment includes a drop-in drive mechanism which is a separate, integral subassembly which can be dropped into a housing in the wrench head and a push-pull operable torsion shaft positioning mechanism slidable between shaft positions of engagement with and disengagement from the drive mechanism.

15 Claims, 10 Drawing Figures

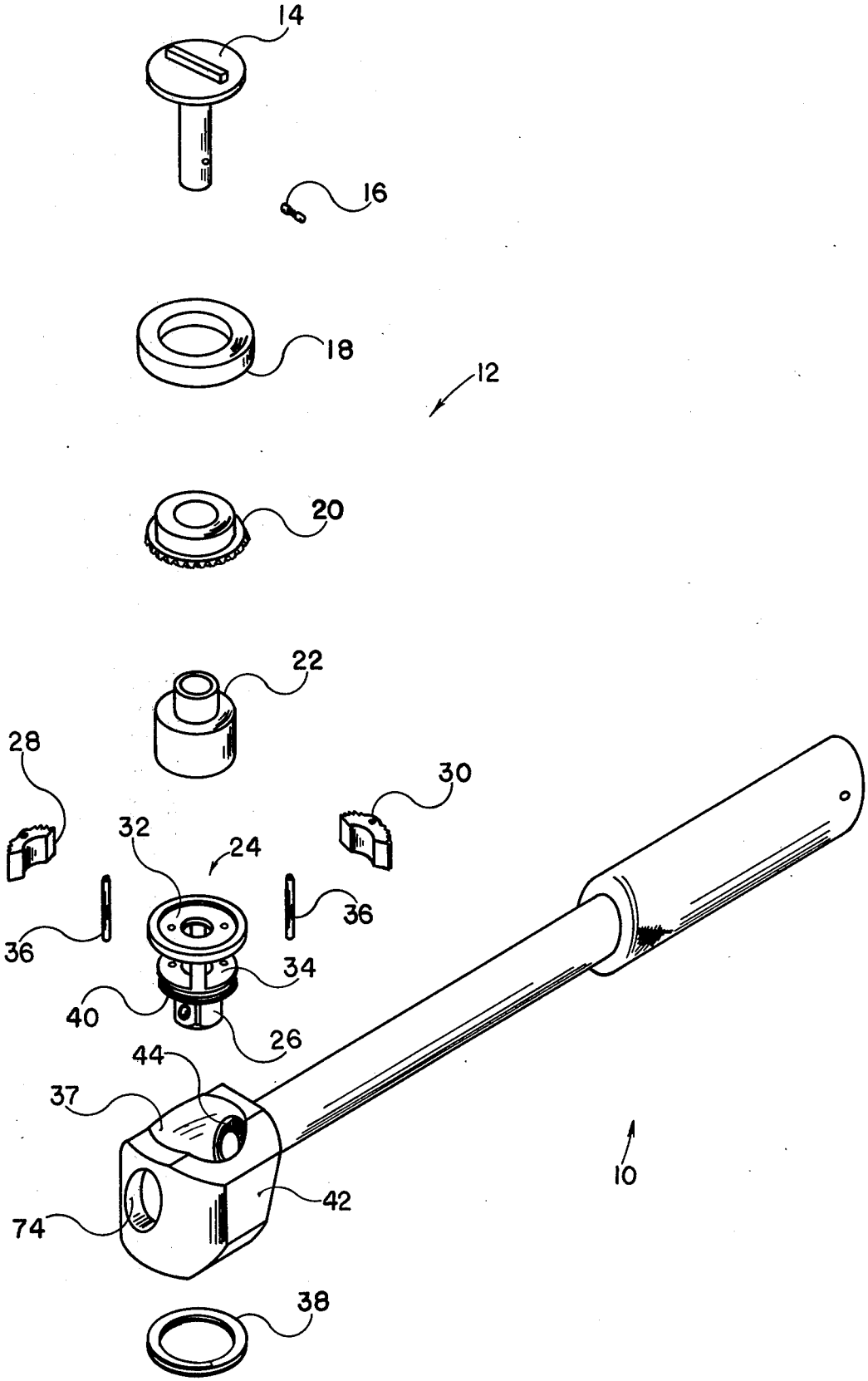
14
16
18
12
20
22
28
30
32
24
36
36
34
40
26
44
37
10
42
74
38

COMBINED RATCHET AND TORSION WRENCH

BACKGROUND AND FIELD OF THE INVENTION

The invention relates in general to wrenches and specifically to that special class of wrenches which are operable either by an oscillating ratcheting movement or by a torsional rotation of a shaft. This special class of wrench shall be referred to herein as a combined ratchet and torsion wrench.

Ratchet wrenches per se are old and very well known in the art. Combined ratchet and torsion wrenches are also old. See, for example, the wrench invented by A. R. McLean as described in U.S. Pat. No. 735,134 which issued Aug. 4, 1903. Other examples of combined ratchet and torsion wrenches are the invention of C. H. Marvin of U.S. Pat. No. 2,703,030 which issued Mar. 1, 1955; of Bernard L. Hofman, U.S. Pat. No. 3,707,893 which issued Jan. 2, 1973; of Wilford Flynn, U.S. Pat. No. 3,733,936 which issued May 22, 1973; and, of John K. Hunter, U.S. Pat. No. 3,972,252 which issued Aug. 3, 1976.

Briefly, a conventional ratchet wrench converts an oscillating, back and forth movement of the wrench handle to a uni-directional rotation of the wrench head output shaft. Typically, the wrench head axis is transverse to the wrench handle. Such handle oscillation mode of operation is very fast compared to a box or open end wrench, particularly in those instances where the wrench handle movement would be limited to only a small arc. In combined ratchet and torsion wrenches, a torsion shaft is provided for also uni-directionally rotating the wrench head output shaft but by a rotation of the torsion shaft about the longitudinal axis of the handle instead of by the conventional oscillating of the handle. Torsion shaft rotation is even faster than the handle oscillation mode of operation under a light load, and makes operation possible in extremely cramped and obstructed work areas where handle movement would otherwise be impossible or limited to only a few degrees of oscillation. Also, a ratchet wrench in effect includes a slip clutch which requires a minimum load and consequently will not work at all under a very light load whereas a torsion shaft can always be rotated. Usually the torsion shaft is concentric with and inside of the handle used to oscillate the ratchet mechanism.

An object of the invention is a combined ratchet and torsion wrench which can be converted from one mode of operation to the other without removing the wrench from the fastener being tightened or loosened.

Another object of the invention is a combined ratchet and torsion wrench which is easy to assemble and maintain.

An additional object of the invention is a combined ratchet and torsion wrench which oprerates even in hard to reach out of the way places.

A further object of the invention is a combined ratchet and torsion wrench which is useable from start to finish of tightening or loosening of a fastener regardless of how easy the fastener turns.

BRIEF DESCRIPTION OF INVENTION

The invention is an improved combination ratchet and torsion wrench. The improvements include a drive mechanism which is assembled as a separate sub-assembly and then inserted as a unit into the head of the wrench and a pushpull positionable torsion shaft.

According to a preferred embodiment of the invention, a combined ratchet and torsion wrench includes a wrench head, an elongate lever attached to and extending from the head for imparting an oscillating motion to the head, a push-pull slidably mounted torsion shaft, and a drive mechanism including an output shaft having a drive end for engaging a tool or other workpiece such as a snap-on socket or screwdriver. The drive mechanism includes motion translation and coupling means for coupling rotational motion of the torsion shaft and oscillational motion of the wrench head to the output shaft as a uni-directional rotation of the output shaft. The drive mechanism also includes a selector for controlling translation of the oscillating motion into either a clockwise or a counter clockwise direction. The torsion shaft includes a spiral bevel gear pinion on the end of the shaft. The pinion imparts a rotational motion to the drive mechanism which includes a mating spiral gear for driving the output shaft and is positionable between positions which provide the pinion in engagement with and disengagement from the drive mechanism bevel gear. The wrench head includes a ratchet wheel integral with the head and the motion translation and coupling means of the drive mechanism includes a set of pawls which are driven by the wrench head ratchet wheel. The selector controls the pawls engagement with the ratchet wheel to provide either clockwise or counter clockwise rotation of the output shaft. Push-pull operation of the torsion shaft positioning mechanism is possible. The positioning mechanism includes a pair of bearing races, each a circumferential groove around the exterior of the elongate lever. One of the grooves corresponds to a position of engagement of the torsion shaft with the drive mechanism and the other to the converse position of disengagement. The area between the grooves is of a reduced diameter which provides grooves having one large and one small sidewall. The torsion shaft includes a handle which is a hollow cylinder and which fits over the lever. A bearing which mates with the grooves is included in and protrudes from the interior of the handle. The bearing is resiliently urged from a radial recess in the handle, specifically, a spring in the recess continuously applies a force to the bearing which tends to force the bearing from the recess. As a result, the bearing is normally held in one of the grooves, but yields to permit withdrawal of the bearing sufficiently into the recess for the bearing to move between the grooves. It has been found that a groove depth, measured from the bottom of the groove to the area between the grooves, of about one-third of the diameter of the bearing diameter provides push-pull operation of the shaft positioning mechanism, in other words, the force longitudinally applied to the handle in order to move the bearing from one groove to another is sufficiently low that changing from one mode of operation to another is readily and easily accomplished with only one hand and without disengaging the wrench socket from a fastener. In the prototype embodiment the drive mechanism comprises an output shaft including a cage within which ratchet pawls are pivotally mounted, a shaft extender, a spiral bevel gear mounted on the shaft extender, and a selector. The output shaft, shaft extender, spiral bevel gear, and selector are all concentric, and slip fit together as an integral unit as a series of partially nesting, axial stages which in turn can be inserted into a housing of the wrench head and secured there with a single flat, coil spring.

BRIEF DESCRIPTION OF DRAWINGS

FIG. 1 is an isometric view of a prototype embodiment of the invention with the drive mechanism portion exploded;

DETAILED DESCRIPTION OF INVENTION

Figure 3:
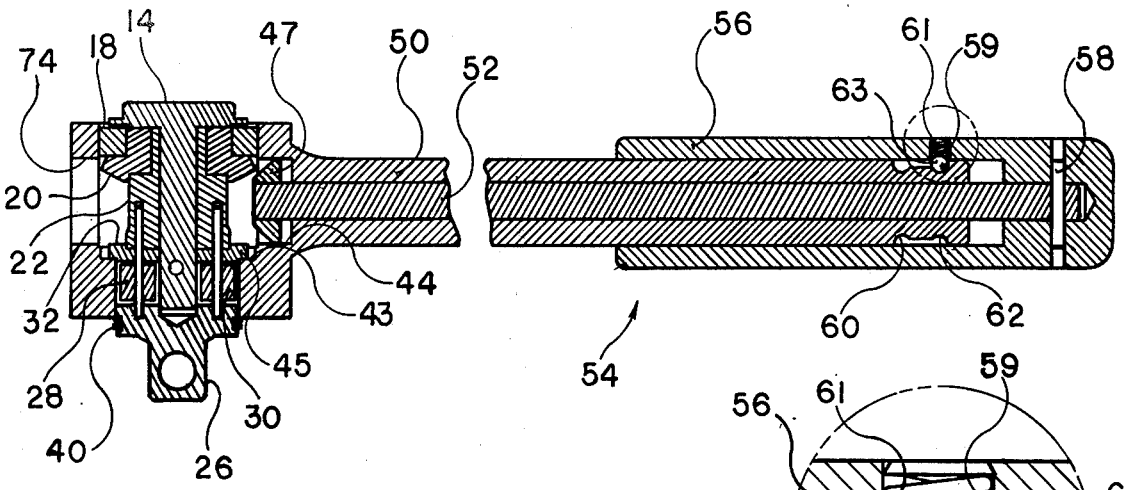
FIG. 3 is a longitudinal sectional view taken along line 3—3 of FIG. 2.

A prototype embodiment of a combination ratchet and torsion wrench is shown generally as 10 in FIG. 1, an isometric view in which the wrench drive mechanism is designated generally as 12 and is exploded. Drive mechanism 12 of the prototype embodiment comprises a selector 14 which includes a pawl cam 16. Also included in drive mechanism 12 is a spacer ring 18, a spiral bevel gear 20, shaft extender 22, and an output shaft shown generally as 24. Output shaft 24 includes a drive end 26, a pair of bi-directional pawls 28 and 30, a pawl cage formed between a pair of annular pivot plates 32 and 34, and a pair of pivot pins each of which are designated as 36. A fastener 38 when seated in groove 40 of output shaft 24 secures an assembled drive mechanism 12 in a cylindrical body portion 42 of the wrench head. Cylindrical body 42 forms a housing which includes opposing open ends the upper of which is designated 37 and is adapted for receiving an assembled drive mechanism 12 and the lower of which is hidden from view. The wrench head also includes an aperture 44 in said body 42 for coupling drive mechanism 12 to a torsion shaft.

Figure 2:
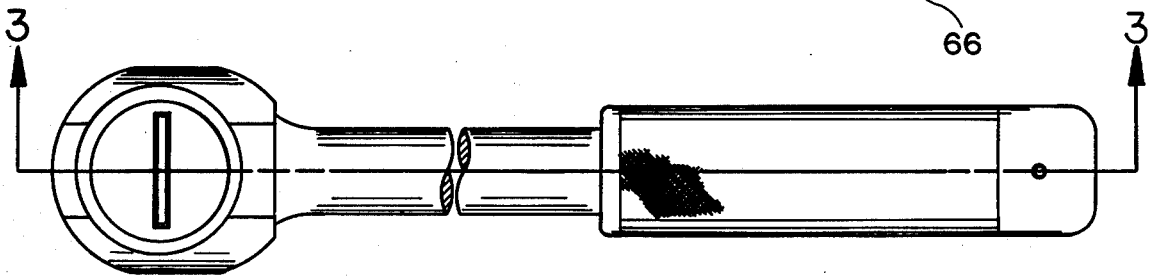
FIG. 2 is a top view of a fully assembled prototype embodiment of the invention.

FIG. 2 is a top view of a fully assembled prototype embodiment of a combination ratchet and torsion wrench according to FIG. 1.

Figure 4:
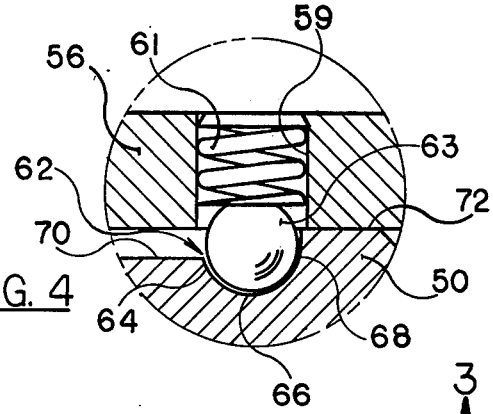
FIG. 4 is an enlarged detail view illustrating the bearing and bearing raceway portions and related structure of the push-pull operable torsion shaft positioning mechanism.

FIG. 3 is a longitudinal sectional view taken along line 3—3 of FIG. 2. Wrench 10 body 42 includes a ledge 43 on which a shoulder 45 seats when an assembled drive mechanism 12 has been inserted into the cylindrical body of the wrench head. An elongate hollow lever 50, a torsion shaft 52 concentric with and within elongate lever 50, and torsion shaft 52 push-pull operable positioning means shown generally as 54 comprise the remainder of wrench 10. Push-pull operable positioning means 54 includes a handle 56 connected by a pin 58 to torsion shaft 52 and also includes a radially extending recess 59, a spring 61 within the recess, a bearing 63, and a pair of circumferential grooves 60 and 62. FIG. 4 is an enlarged detail view of a portion of the torsion shaft positioning mechanism 54 in which it is shown that groove 62 includes a small sidewall 64, bottom 66, and large sidewall 68, and lever 50 is shown to have an area of reduced diameter 70 which is between grooves 60 and 62 and an area of normal diameter 72. The combination of recess 59 and reduced diameter 70 permits withdrawal of bearing 63 into recess 59 whereby bearing 63 can move between grooves 60 and 62. Spring 61 resiliently urges bearing 63 to a position of maximum protrusion from recess 59, which varies according to the position of handle 56, namely, against reduced diameter 70 as the handle moves shaft 52 between grooves 60 and 62, and against the bottom 66 of grooves 60 and 62 when the handle 56 is respectively in positions placing shaft 52 in engagement with and disengagement from drive mechanism 12.

Figure 6:
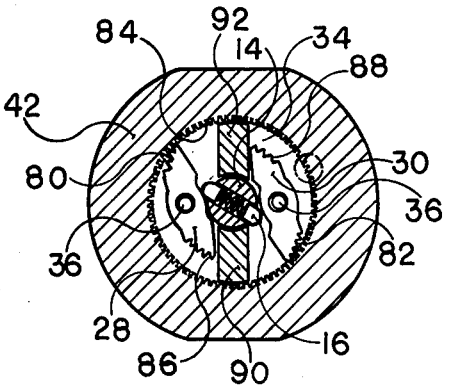
FIG. 6 is a sectional view through the wrench head and drive mechanism taken along line 6—6 of FIG. 5.
Figure 5:
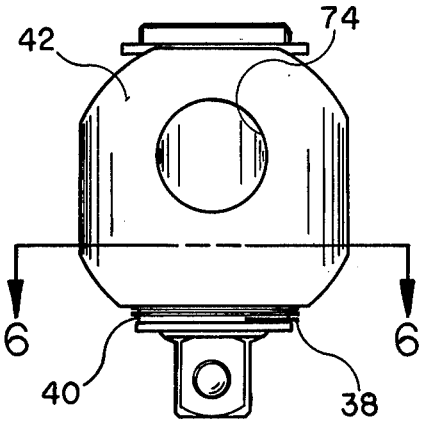
FIG. 5 is an end view of the combination ratchet and torsion wrench invention of FIG. 2.

FIG. 5 is an end view of the ratchet and torsion wrench of FIG. 2. Housing hollow body portion 42 includes aperture 74 through which torsion shaft 52 is inserted into lever 50 as will be described more fully later. FIG. 6 is a sectional view through housing body portion 42 and drive mechanism 12 along line 6—6 of FIG. 5 at a point just above pawls 28 and 30. In FIG. 6, selector 14 pawl cam 16 holds pawls 28 and 30 in position to turn output shaft 24 (hidden from view beneath annular pivot plate 34) in a counter clockwise direction. Counter clockwise ends 80 and 82 of pawls 28 and 30, respectively, pivot to permit clockwise rotation of the wrench head body portion 42 relative to output shaft 24 but engage the teeth 84 in body portion 42 which form a ratchet wheel and turn output shaft 24 for counter clockwise rotation of the wrench head body portion 42. When ends 80 and 82 are engaged in the ratchet wheel teeth 84, the clockwise ends 86 and 88 respectively abut stops 90 and 92. Clockwise turning of output shaft 24 is the opposite. Selector 14 is turned to cam clockwise ends 86 and 88 against ratchet wheel teeth 84. Pawls 28 and 30 pivot for counter clockwise rotation of body portion 42 but mesh in teeth 84 and ends 80 and 82 abut stops 92 and 90 for clockwise rotation of body portion 42.

A combined ratchet and torsion wrench according to FIGS. 1 through 7, the latter of which is an enlarged view of several of the ratchet wheel teeth, was made from the materials and with the parameters, dimensions, and characteristics set forth in Table I below:

- body portion 42 and elongate lever 50: machined from a 2 inch square by 12 inch long bar of stress proof steel to size and shape as shown in FIG. 3 wherein the cross-section is shown in three-fourths ($\mu$) scale; for reference purposes, handle 50 was three-fourths of an inch in diameter and the diameter of the spindle of selector 14 was eleven thirty seconds of an inch; a brass bushing (not shown) was included in lever 50 at its juncture with body portion 42 as a journal for torsion shaft 52;
- ratchet wheel 84: a total of 45 teeth; the basic tooth thickness was about one-half the width of the circular pitch between adjacent teeth; further particulars regarding ratchet wheel teeth are set forth in various machinery handbooks, for example on page 821 of the 11th Edition of Machinery's Handbook 1941 Copyright by the Industrial Press;

Drive Mechanism 12 pawl cam 16: believed to be salvaged from a conventional Herbrand (TM) model ratchet wrench;

pawls 28 and 30: the original manufacturer is unknown; they too are believed to have been salvaged from the same wrench as the pawl cam 16;

selector 14: machined and turned to size and shape, 1.80 inches in overall length, with a 0.340 inch diameter spindle with a 0.220 inch diameter hole for cam pawl 16, of cold rolled steel;

spacer ring 18: 0.966 inch inside diameter by 1.410 inch outside diameter by 0.240 inch thick cold rolled steel;

spiral bevel gear 20: 19 minute pitch, 20 degree pressure angle bevel gear sold by the Boston Gear division of Rockwell International, 3200 Main St., Quincy, Massachusetts 02177 as its part no. 55192-G;

shaft extender 22: 0.355 inch inside diameter with a 0.385 inch long by 0.500 inch outside diameter neck and 0.675 inch long by 0.970 inch outside diameter base including pawl pivot pin 36 mounting holes spaced apart 0.700 inches center to center and 0.325 inches from the drive mechanism longitudinal axis; further particulars regarding the position of the pawl pivot location are included in the Machinery's Handbook Section on ratchet wheel teeth; turned from a one inch diameter length of cold rolled steel;

output shaft 24: turned to size and shape from a 1¼ inch diameter length of cold rolled steel;

torsion shaft 50: 0.250 inch diameter, mild steel rod; a 5/32 inch diameter hole is provided for passage of pin 58;

pinion 47: a 19 minute pitch, twenty degree pressure angle spiral bevel gear pinion sold by said Boston Gear company as its part 55792-P;

Shaft Positioning Mechanism 54 handle 56: a 1⅛ inch diameter by 4⅜ inch long length of mild steel rod with a 13/16 inch diameter by about 3½ inch deep bore and about a 3/16 inch diameter recess 59 with 0.0125 inch diameter holes for pin 58;

pin 58: ⅛ inch diameter steel spring pin;

bearing 63: ⅛ inch diameter ball bearing;

spring 56: exact characteristics unknown and not considered critical in any way except that it should provide sufficient force to hold bearing 63 in the grooves to prevent unintended movement of the torsion shaft 52 between positions of engagement and disengagement yet not so much as to make movement of the torsion shaft between the positions difficult;

grooves 60 and 62: position of the front groove 60 is important for it fixes engagement of pinion 47 with gear 20, the position of the rear groove 62 need only insure total disengagement between pinion 47 and gear 20; the grooves were spaced apart 5/16 inch, center to center, and were milled into shaft 50 to a depth beyond reduced diameter 70 of about one-third the diameter of bearing 63, nominally about 0.042 inch, and had a radius of bottom surface 66 to provide a bearing race of a conventional tolerance for bearing 63;

reduced diameter area 70: ⅝ inch;

fastener 38: a flat coil spring of sufficient outside diameter to hold the drive mechanism in body portion 42.

The prototype embodiment assembled with the above components was assembled by press fitting pinion 47 onto shaft 52. The brass bushing (not shown) was inserted into lever 50 and shaft 52 was inserted through the aperture 74 in body portion 42 into lever 50. Handle 56 was slid over lever 50 and the end of shaft 52 and pin 58 inserted. Bearing 63 and spring 61 were inserted into recess 59 and the recess opening peaned or swaged sufficiently to hold the spring in the recess. Drive mechanism 12 was assembled by positioning pawls 28 and 30 in the pawl cage of output shaft 24 and inserting pins 36. Shaft extender 22 was slid over the protruding ends of pins 36 and press fit into a recess in annular pivot plate 32 on the top of output shaft 24. Spiral bevel gear 20 was press fit onto the neck of shaft extender 22, spacer ring 18 loosely fit around the base of gear 20, and selector 14, with pawl cam 16 compressed flush with the selector spindle, inserted through shaft extender 22 and into the pawl cage of output shaft 24 whereupon the spring of the pawl cam 16 expanded from the spindle of selector 14 to push against pawls 28 and 30. (To dissassemble a drive mechanism 12, the cam pawls 28 and 30 ends then in contact with cam pawl 16 are pushed inwardly through the opening in the pawl cage between stops 90 and 92 to force cam pawl 16 entirely into the selector 14 spindle which then allows withdrawal of selector 14 and dissassembly of the remaining components in the reverse of the foregoing procedure.) Assembly completion of the prototype combination ratchet and torsion wrench 10 consisted of merely dropping the assembled drive mechanism 12 into the wrench head body portion 42 housing until shoulder 45 of output shaft 24 seated on ledge 43 after which drive mechanism 12 was secured in the housing with a fastener 38 in groove 40. The semi-nesting, assembly structure with axial stages, of drive mechanism 12, and the concentric, pinned connection of lever 50, shaft 52, and handle 56 provides a wrench which is easy to assemble. The wrench is also easy to maintain, and dissassembly is as easy and straightforward as assembly to permit ready replacement of any defective or worn out part, such as ratchet pawls and bevel gears which are known to require comparatively frequent replacement. Operation of the foregoing prototype embodiment in a ratcheting mode is the same as for any other ratchet wrench. All that need be done to operate the wrench in the torsion mode is to set selector 14 in the position providing the desired direction of turning of output shaft 24 and to push handle 56 forward. In use, prototype embodiment combined ratchet and torsion wrench 10 has been found to provide tightening and loosening of a fastener from start to finish, even for fasteners which turn with practically no resistance at all. The invention accomplishes such start to finish tightening by converting from one mode of operation to another, using the torsion mode of operation when the fastener presents little resistance to turning and the ratchet mode when the fastener presents sufficient resistance to turning to make turning the handle 56 slow in the torsion mode. It has also been found easy to convert the wrench from one mode of operation to the other without removing the wrench from the fastener which has made tightening fasteners or loosening fasteners in hard to reach, out of the way places possible and comparatively easy.

Figure 8:
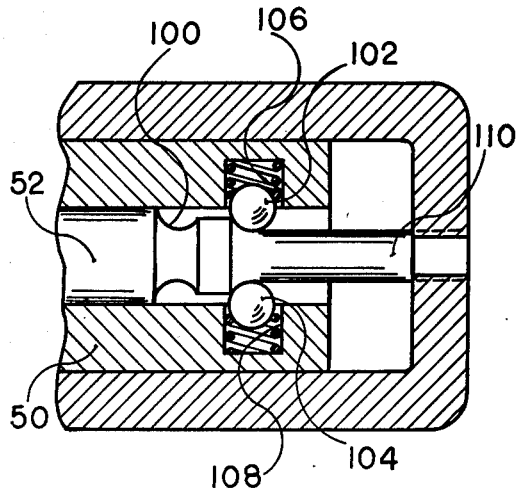
FIG. 8 is a fragmentary longitudinal sectional view of a combination ratchet and torsion wrench illustrating an alternative push-pull torsion shaft positioning mechanism.

FIG. 8 is a fragmentary longitudinal sectional view of an alternative embodiment of a torsion shaft positioning mechanism for a combination ratchet and torsion wrench. According to the embodiment of FIG. 8, torsion shaft 52 includes a groove 100 and elongate lever 50 includes a pair of bearings 102 and 104 in recesses 106 and 108. Shaft 52 is connected to a handle 56 by a lesser diameter section 110 of the shaft. Another alternative embodiment of a torsion shaft positioning mechanism is shown in a similar view in FIG. 9. The alternative embodiment of FIG. 9 includes a bearing 120 in a recess 122 of shaft 52 and a bearing race 124 is included in lever 50. Shaft 52 includes an enlarged section 126 for push-pull positioning and rotation of shaft 52. FIG. 10 is a side elevational view in section of an alternative embodiment of a drive mechanism 12. Output shaft 24 includes a conventional drive end 26 and retainer groove 40 the same as the output shaft of the embodiment of FIGS. 1 through 7, and includes a drive mechanism seating shoulder 130 similar to shoulder 45 of the prototype embodiment. The output shaft 24 of the alternative embodiment of FIG. 10 includes a core 132 having two steps of diameter 134 and 136 onto which are press fit matching spiral gears 138 and 140 which are identical right and left hand spiral gears and are otherwise identical except for their inside diameters. A pawl and selector mounting ring 142, a ratchet plate 144, pawls 28 and 30, pins 36, and a selector 14 complete the alternative embodiment drive mechanism of FIG. 10. Ratchet plate 144 includes stops 90 and 92 (not shown) and has a circular geometry the same as ring 142.

In the event of any discrepancy between a dimension in the scale drawings and the dimensions given in Table 1, the dimension of Table 1 is to govern.

Figure 9:
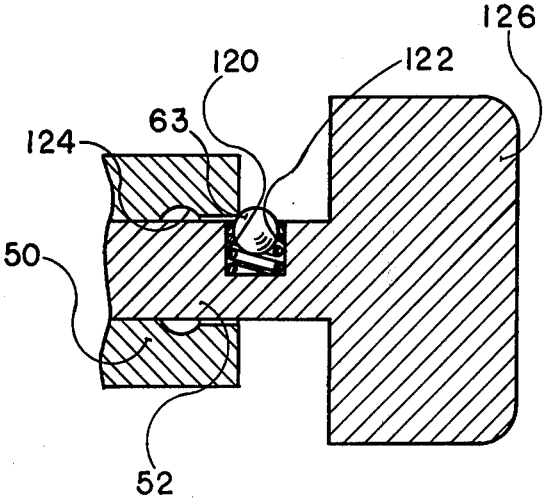
FIG. 9 is a fragmentary, longitudinal view of a combination ratchet and torsion wrench illustrating another alternative push-pull torsion shaft positioning mechanism; and, FIG. 10 is a partially cut-away sectional view through a head of a combination ratchet and torsion wrench illustrating an alternative embodiment of a drive mechanism.
Figure 10:
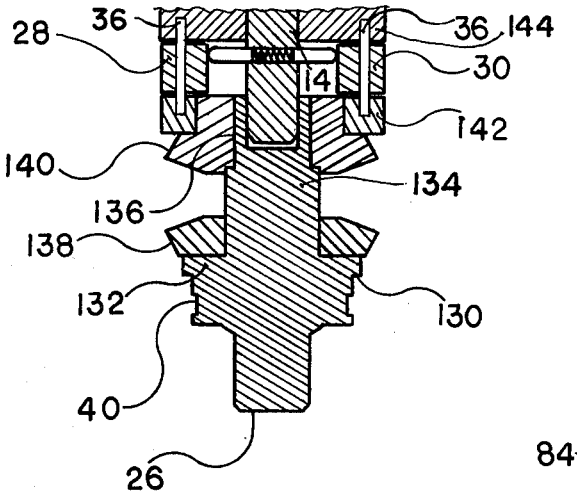
Figure 7:
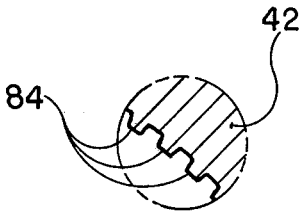
FIG. 7 is an enlarged view of several ratchet wheel teeth of the wrench head of FIG. 6.

The foregoing, including the alternative embodiments of FIGS. 8 through 10 has been given by way of illustration and not limitation. Modifications and variations thereof obvious to one of ordinary skill in the art are within the scope of the invention. For example, again by way of illustration and not limitation, the advantages derived from the unitary nature of the drive mechanism are independent of the particular housing within which it is mounted and its use with other housings is deemed within the scope of the invention. The true scope of the invention is as set forth in the following claims.

What is claimed is:

1. For a combination ratchet and torsion wrench having a drive mechanism housing in a wrench head, a lever extending from and for oscillating said head, and a torsion shaft parallel to said lever and moveable between positions of engagement with and disengagement from a drive mechanism in said housing, a drive mechanism comprising: an elongate output shaft having a pawl cage including a ratchet wheel integral with said housing and including a drive end extending from said wrench head and adapted for engaging a tool or other workpiece such as a snap-on socket or screwdriver and having its other end extending interiorly of said head; which pawl cage includes first and second annular pivot plates spaced apart along the axis of said output shaft axis a distance sufficient to accept a pawl, which pivot plate furthest from said output shaft drive end includes a central aperture, each said plate includes pivot pin apertures and said pawl cage includes a pair of pivot pins secured in said pivot pin apertures and extending between said pivot plates; and, coupling and translation means for selectively turning the end of said output shaft extending interiorly of said head in a clockwise and a counter clockwise direction in response to oscillation of said wrench head and rotation of said torsion shaft; which coupling and translation means includes a pair of semi-circular double acting pawls pivotally mounted on said pivot pins within said pawl cage and which pawls are responsive to oscillation of said head to turn said output shaft; which coupling and translation means includes an apertured torsion gear and an apertured shaft extender fixedly interconnected between said output shaft and said torsion gear, which torsion gear, pivot plate central aperture, and shaft extender apertures are concentric and wherein said torsion gear provides disengageable coupling to said torsion shaft and is responsive to rotation of said torsion shaft to rotate said output shaft; a selector for selecting the direction which said output shaft drive end is turned, which selector includes a spindle extending through said torsion gear and shaft extender and into said pawl cage through said pivot plate central aperture to provide access to and positioning of said pawls by said spindle to select the direction which said output shaft is turned by positioning one end of each of said pawls in engagement with said ratchet wheel for clockwise turning of said output shaft and to position the other end of said pawls in engagement with said ratchet wheel for turning said output shaft in a counter clockwise direction; and, wherein said output shaft and coupling and translation means are a series of seminesting, axial stages which can be assembled as an integral drive mechanism sub-assembly and inserted into and secured by a fastener means in said wrench head drive mechanism housing.

2. For a combination ratchet and torsion wrench according to claim 1, the improvement wherein an outwardmost one of said pivot plates extends out of said housing and said fastener means attaches to said outwardmost pivot plate to prevent withdrawal of said outwardmost pivot plate into said housing and thereby secure said drive mechanism in said housing.

3. For a combination ratchet and torsion wrench according to claim 2, the improvement wherein said housing includes a seat for accepting said interiormost pivot plate to limit the extension of said output shaft from said housing, said outwardmost pivot plate includes an annular groove, and said fastener means comprises a spring clip which seats in said annular groove.

4. A combination ratchet and torsion wrench comprising:

(A) a wrench head;

(B) an elongate lever extending from and for imparting an oscillating output motion to said head;

(C) a torsion shaft for providing a rotational output motion;

(D) push-pull operable torsion shaft positioning means for positioning said torsion shaft in an engagement position and in a disengagement position including torsion shaft position biasing means for biasing said torsion shaft in said position of engagement and in said position of disengagement, and which biasing means comprises a combination totaling at least three of a bearing and a bearing race and wherein whichever of said bearing and bearing race is the lesser in number of the two is in association with one of the other in said position of engagement and in association with the second of the other in said position of disengagement; and, (E) a drive mechanism having an output shaft and including output motion coupling and translation means for uni-directionally turning said output shaft in response to rotational output motion from said torsion shaft when said torsion shaft is in said position of engagement and in response to oscillating output motion from said head.

5. A combination ratchet and torsion wrench according to claim 4 wherein said biasing means includes at least one bearing and at least one bearing race, one of which bearing and bearing race is integral with said torsion shaft and the other of which is integral with said lever, which bearing race is concentric with said torsion shaft and which bearing and bearing race are moveable relative to each other axially of said torsion shaft between a position of association with each other with said torsion shaft in said position of engagement and a position of disassociation from each other with said torsion shaft in said position of disengagement.

6. A combination ratchet and torsion wrench according to claim 5 wherein said biasing means comprises a single bearing and a single bearing race, said lever and said shaft are concentric telescoping members which include an area of noncoextensiveness when said shaft is in said position of disengagement, and wherein said bearing resides in an area of noncoextension of said members with said torsion shaft in said position of disengagement.

7. A combination ratchet and torsion wrench according to claim 4 wherein said positioning means comprises a bearing and a pair of raceways, said lever and said shaft are concentric, telescoping members, and wherein the positions of said bearing raceways respectively correspond to said position of engagement and disengagement and said bearing is responsive to a force along said torsion shaft to move between said raceways.

8. A combination ratchet and torsion wrench according to claim 7 wherein said bearing is integral with said lever and said raceways are integral with said shaft.

9. A combination ratchet and torsion wrench according to claim 8 wherein said lever is a hollow cylinder and said shaft is within said cylinder.

10. A combination ratchet and torsion wrench according to claim 7 wherein said bearing is integral with said shaft and said bearing raceways are integral with said lever.

11. A combination ratchet and torsion wrench according to claim 10 wherein said lever is a hollow cylinder and said shaft is within said cylinder.

12. A combination ratchet and torsion wrench according to claim 11 wherein said shaft includes a handle which is concentric with and fits over said lever.

13. A combination ratchet and torsion wrench according to claim 12 wherein each said raceway comprises a circumferential groove in said lever, each of which grooves includes a curved bottom portion radiused to closely conform which said bearing and a pair of wall portions extending from said bottom portion.

14. A combination ratchet and torsion wrench according to claim 13 wherein the heighth of said wall portions are defined by diameters of said lever, wherein the heighth of the two interior raceway wall portions from the bottom of the raceway is about two-thirds of and the heighth of the exterior raceway wall portions is somewhat more than the diameter of said bearing.

15. A combination ratchet and torsion wrench according to claim 14 wherein said bearing includes a bearing recess in said handle and means for resiliently urging said bearing to a position of maximum extension from said recess but which yields to permit withdrawal of said bearing into said recess as said bearing moves between said raceways.

* * * * *